United States Patent [19]

Hodge

[11] 3,968,617

[45] July 13, 1976

[54] BUILDING STRUCTURE

[76] Inventor: John S. Hodge, 2350 Westridge Court, Ferndale, Mich. 48220

[22] Filed: Nov. 20, 1974

[21] Appl. No.: 525,369

Related U.S. Application Data

[62] Division of Ser. No. 340,595, March 12, 1973, Pat. No. 3,861,102.

[52] U.S. Cl. ..... 52/720; 52/233; 52/494; 52/284; 52/282

[51] Int. Cl.[2] ..... E04C 3/30; E04B 1/10

[58] Field of Search ..... 52/726, 738, 720, 593, 52/595, 494, 495, 233, 282

[56] References Cited

UNITED STATES PATENTS

| | | | |
|---|---|---|---|
| 1,445,738 | 2/1923 | Adams | 52/233 X |
| 1,655,701 | 1/1928 | Hyland et al. | 52/233 |
| 3,206,903 | 9/1965 | Johnson | 52/494 X |
| 3,299,594 | 1/1967 | Kellert | 52/284 X |
| 3,350,824 | 11/1967 | Wiebusch | 52/282 X |
| 3,423,891 | 1/1969 | Burris | 52/282 X |
| 3,511,005 | 5/1970 | MacMaster | 52/595 X |
| 3,566,561 | 3/1971 | Tozer | 52/282 X |
| 3,681,888 | 8/1972 | Kim | 52/593 X |

*Primary Examiner*—Ernest R. Purser
*Assistant Examiner*—Robert Farber
*Attorney, Agent, or Firm*—Lon H. Romanski

[57] ABSTRACT

A building structure of either single or multi-story construction employs wall panels and columns each of which may be fabricated as at a factory and transported to the building site and there erected in a generally modular mode of operation.

7 Claims, 34 Drawing Figures

BUILDING STRUCTURE

RELATED APPLICATION

This application is a division of my copending application Ser. No. 340,595 filed Mar. 12, 1973, now U.S. Pat. No. 3,861,102 for "BUILDING STRUCTURE".

BACKGROUND OF THE INVENTION

Presently there is a need for what may be termed low cost housing and buildings. The building and construction industry has attempted to solve such problems by deliberately reducing the overall quality of such structures to the absolute minimum acceptable standards. However, in so doing whatever savings in money are realized are those which are primarily attributable to the cost of materials employed and the elimination of certain features which, although desirable, are not considered essential to the utility of the overall structure.

The reason that savings are limited to such areas is because the employment of skilled tradesmen, at the construction site, for the cutting and fitting of the various components requires the payment of the same hourly rate of pay even though the resulting structure may be considered "low cost."

There have been other attempts to reduce costs as by the construction of prefabricated structures within a factory and then transporting such prefabricated structure to its intended site. However, this method requires the expense of moving such prefabricated structures (with attendant possibilities of damage thereto) and is further limited to the construction of prefabricated structures which can be physically accommodated within the factory.

Further, prior art attempts at mass production of building structures, as by prefabrication of component portions thereof, have generally followed the basic building practices heretofore established for many years. That is, the conventional wall plates, wall studs, sheeting, exterior siding and interior wall finishing is employed for constructing the prefabricated component portions. Except for a few basic departures, most of which employ the geodesic principle, resulting in dome-like configurations, the prior art has not made any significant attempts to combine the advantages of easily and quickly erectable structures with the concept of minimizing the required material for building such structures as by developing component configurations which will maximize the stress carrying capabilities of such components.

Accordingly, the invention as herein disclosed and described is primarily directed to the solution of the above and other attendant problems.

SUMMARY OF THE INVENTION

According to the invention, a building structure comprises a plurality of spaced vertically extending support columns, a plurality of separate wall panels respectively situated between said spaced support columns, and means operatively interconnecting said plurality of columns as to thereby result in structural integrity of said columns and said wall panels.

Various general and specific objects and advantages of the invention, among which is the ability to manufacture standardized type of components in a factory and then without assembly ship such components to the building site, will become apparent when reference is made to the following detailed description considered in conjunction with the drawings.

BRIEF DESCRIPTION OF THE DRAWINGS

In the drawings, wherein for purposes of clarity certain elements or details may be omitted from one or more views.

DESCRIPTION OF THE PREFERRED EMBODIMENT

Figure 1:
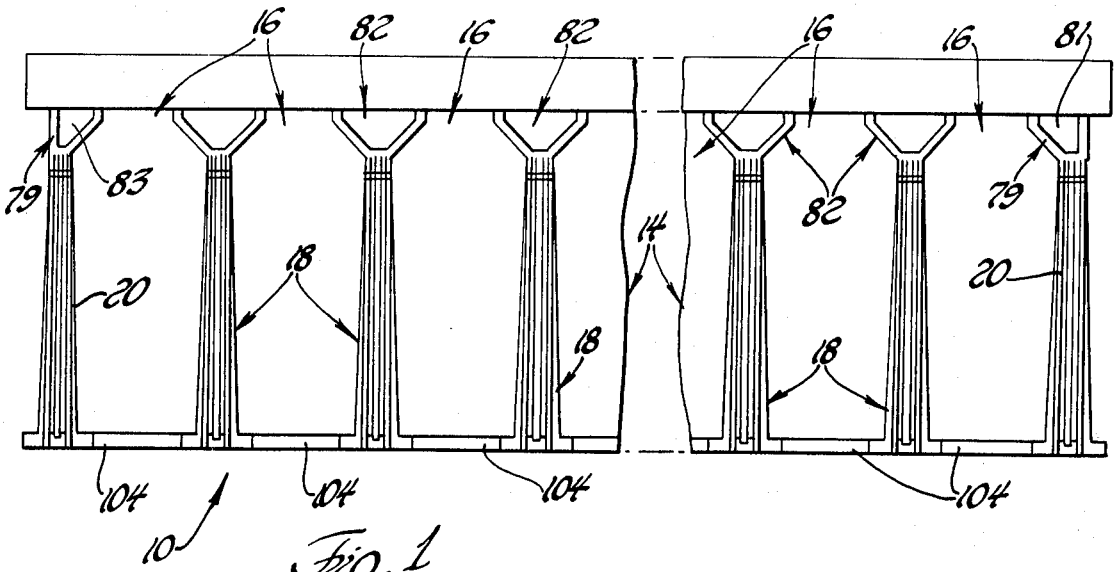
FIG. 1 is a side elevational view of a building structure embodying the teachings of the invention.
Figure 2:
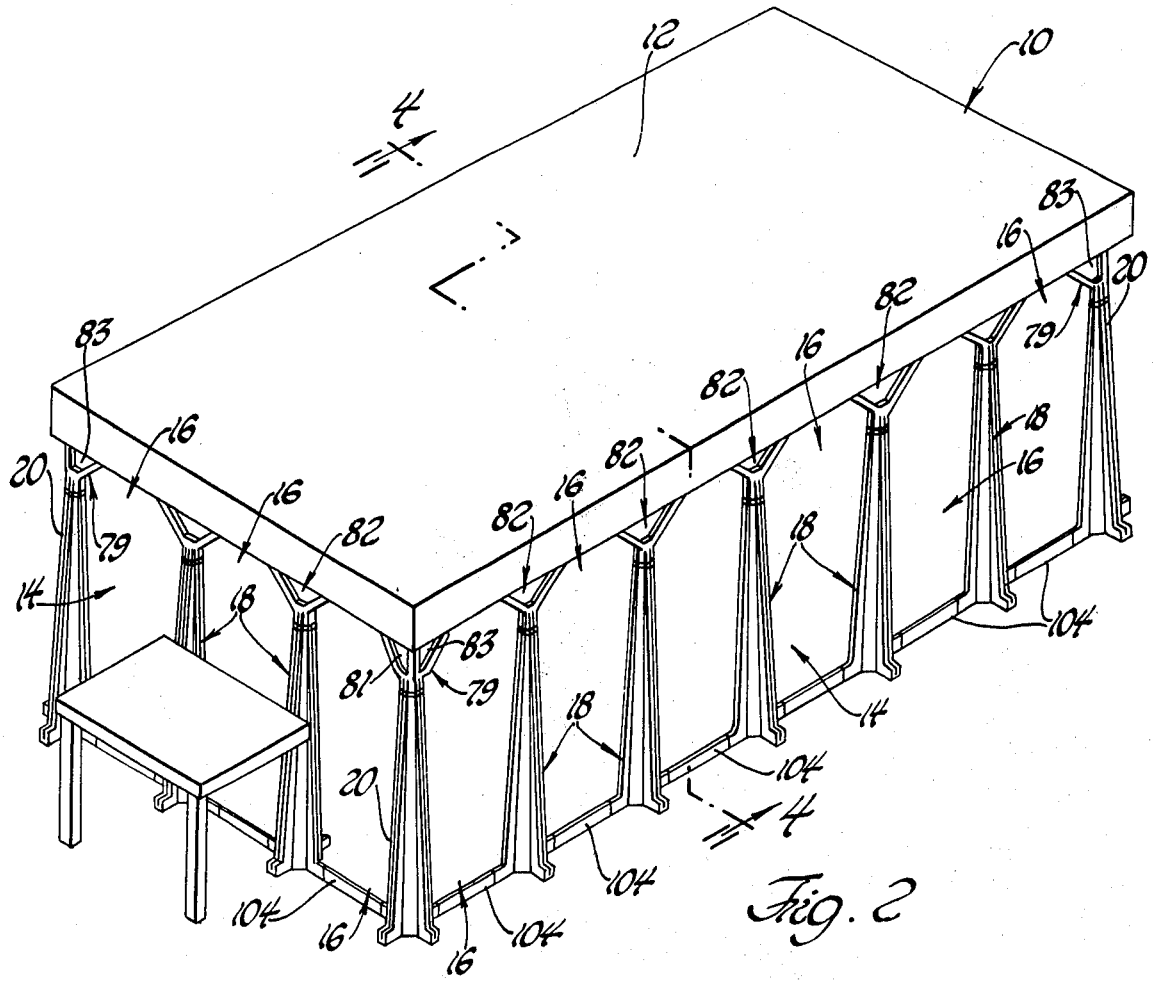
FIG. 2 is a perspective view of the structure of FIG. 1.

Referring now in greater detail to the drawings, FIG. 1 illustrates, in side elevational view or building or structure 10 embodying the teachings of the invention with FIG. 2 being a perspective view of such structure with the addition thereto of, for example, a suitable roof over the entry to such building.

Generally, the structure 10 is illustrated as being comprised of a roof 12 supported as by vertically extending wall assemblies 14 which, in turn are comprised of cooperating alternating wall panels 16 and columns or posts 18 and 20 with columns 18 being employed within the run of the wall assembly while columns 20 are employed as corner columns or posts.

Figure 3:
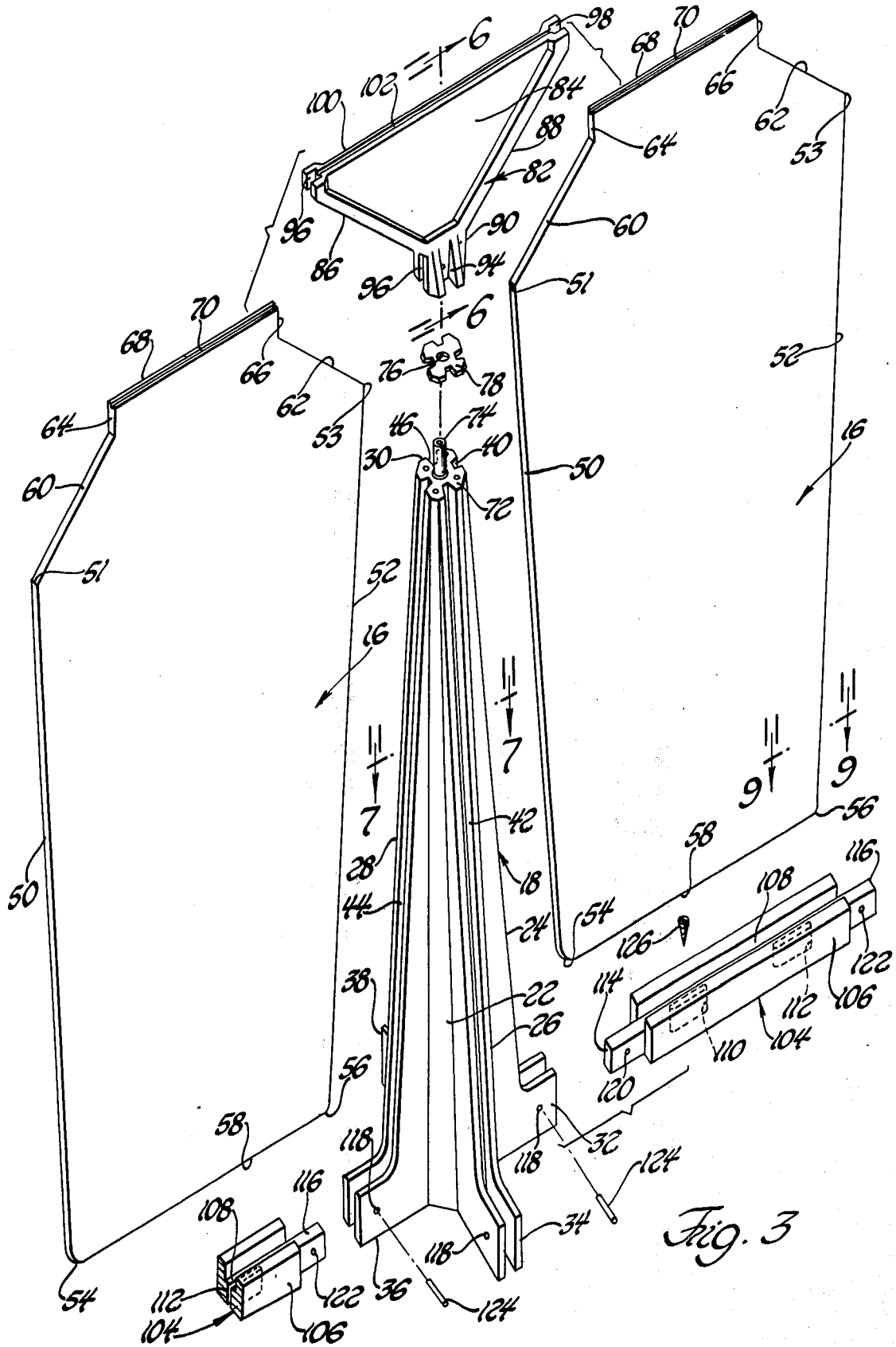
FIG. 3 is an enlarged exploded view of certain of the elements shown in each of FIGS. 1 and 2.

FIG. 3 illustrates in exploded perspective view the general manner of assembly and inter-relationship of the elements shown in FIGS. 1 and 2. As can be seen, in the preferred embodiment columns 18 are comprised of a main vertically extending body portion 22 having axially aligned legs 24, 26, 28 and 30 formed integrally therwith and angularly spaced thereabout as, for example, at 90° intervals. Legs 24, 26, 28 and 30 respectively terminate in aligned foot-like portions 32, 34, 36 and 38. Further, grooves or recesses 40, 42, 44 and 46 are respectively formed in legs 24, 26, 28 and 30 in a manner as to extend downwardly into the respective aligned foot portions 32, 34, 36 and 38. As typically illustrated in FIG. 4, such grooves preferably terminate in a vertical slot 48 formed in each of the foot portions.

Wall panels 16 are preferably of a generally trapezoidal configuration having opposed slanting side wall edges 50 and 52 terminating at their lower ends in arcuate corners 54 and 56 each blending into a lower edge 58. At the upper end of each panel 16, oppositely sloping edges 60 and 62 extending generally upwardly as to meet generally vertically extending wall edges 64 and 66 which, in turn, terminate in an upper panel edge 68. As illustrated, in the preferred embodiment, each upper edge 68 has a groove 70 formed therein and coextensive therewith.

The top of each column 18 is preferably truncated, as at 72, and provided with an upwardly extending locating member 74 which is received through an aperture 76 formed in a seal 78 as well as received within a cooperating aperture 80 formed in a capping or filler plate member 82.

As shown, the plate member 82 may be comprised of a generally triangular panel-like body portion 84 provided with upwardly extending and outwardly directed boundary like edge portions 86 and 88 which, at their respective lower ends, terminate in what may be referred to as an extension 90 of column 18. The extension 90 has opposed grooves 92 and 94 formed therein which respectively align with grooves or recesses 46 and 42 of column 18 and a second set of opposed grooves or recesses 96 and 98 which not only respectively align with grooves 44 and 40 of column 18 but also respectively continue upwardly coextensively with edge portions 86 and 88. Further, the top edge 100 of plate member 82 preferably has a groove 102 formed therein and coextensively therealong.

Figure 4:
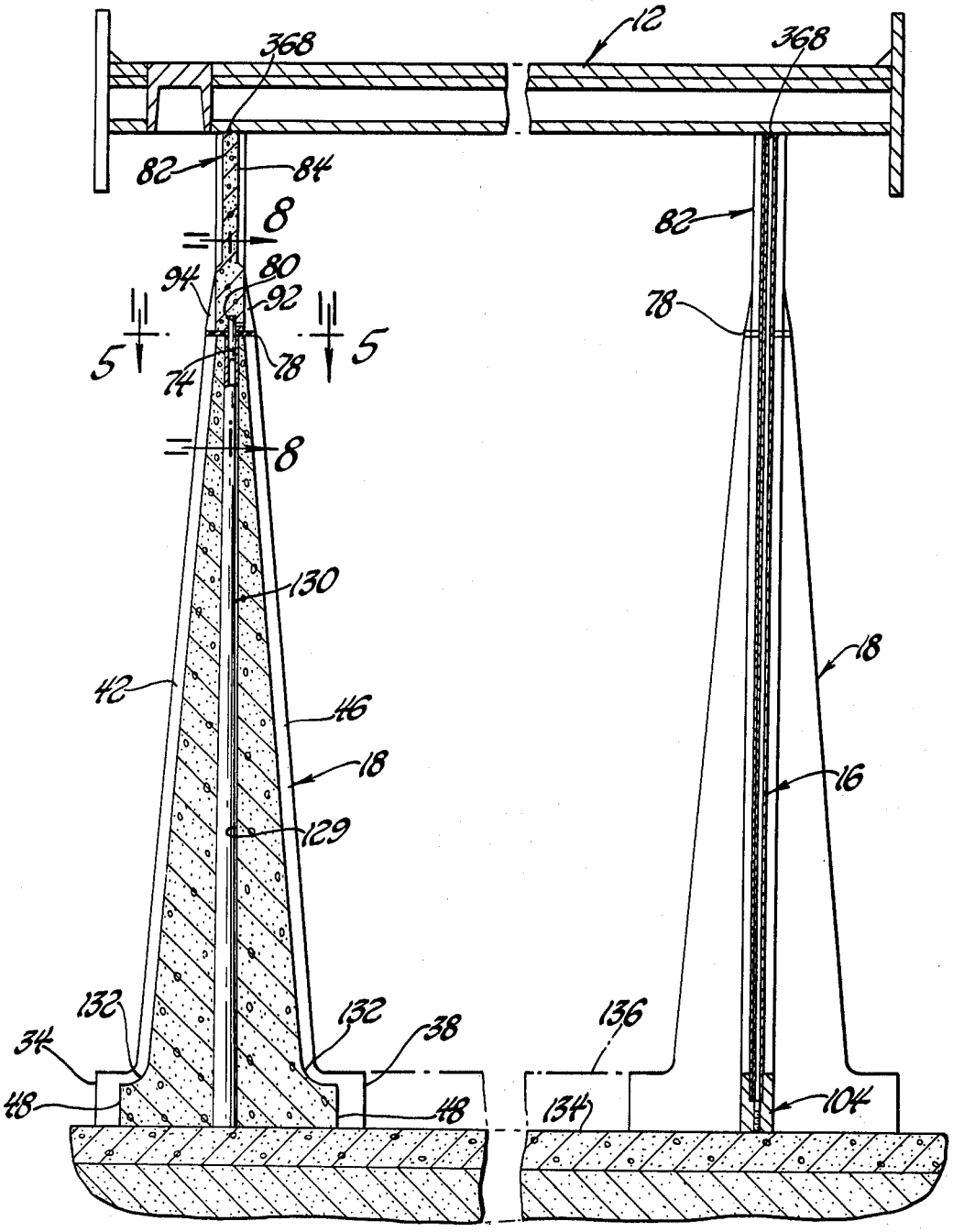
FIG. 4 is an enlarged cross-sectional view taken generally on the plane of line 4—4 of FIG. 2 and looking in the direction of the arrows.

As also shown in FIG. 3, lower connecting or base members 104 are preferably provided so as to both receive therein a portion of the cooperating wall panel 16 and to join succeeding columns 18 to each other. As typically illustrated, such base members 104 may be comprised of a main body 106 having a longitudinally extending slot or groove 108 formed therein with elongated slots or apertures 110 and 112 formed therethrough and opening into such groove 108. Further tongue-like extensions 114 and 116 are provided at opposite ends of the body 106 as to be aligned with slot 108. With reference also to FIG. 4, extensions 114 and 116 are of a length as to be receivable within slots 48 formed in the foot portions of columns 18 while the inner-most longitudinal surface of groove 108 is at an elevation substantially equal to the elevation of such cooperating grooves within the same foot portions. As best seen in FIG. 3, each of the column foot portions is provided with a through aperture 118 while extension 114 has an aperture 120 formed therethrough and extension 116 has an aperture 122 formed therethrough.

Generally, in assembling a building embodying the invention, base columns 18 and base members 104 may be first assembled, atop any suitable support means, as by having the extensions 114 and 116 received by the slots of the foot portions. For example, still referring to FIG. 3, one of the bases 104 would have extension 116 received in slot 48 of foot 36 thereby placing its groove 108 in line with groove 44 so as to form a continuation thereof while the other shown base 104 would have its extension 114 received in slot 48 of foot 32 thereby placing its groove 108 in registry with groove 40 so as to form a continuation thereof. When bases 104 are thusly assembled to foot portions 36 and 32, suitable pins, bolts or any other effective retaining means, such as at 124, are inserted respectively through then aligned holes 118, 122 and 118, 120 thereby securing the bases 104 to the intermediately located column 18 and making such components into a unitary structure. Of course, succeeding columns and bases are similarly interconnected as to form the continuous wall 14.

As the columns 18 and bases 104 are connected to each other some relative movement may be necessary as between coacting column and base. Since in the preferred embodiment bases 104 are secured to a lower support surface, as by fastening means 126 extending through slots 110, such slots 110 are elongated to enable the movement of such bases 104 relative to the said lower support surface and whatever anchoring means may be provided therein for coaction with said fastening means 126.

In the preferred sequence of operations, the various components are assembled as follows. That is, for example, a base 104 is secured to a column 18, then the filler or capping plate member 82 is affixed atop the column 18, then a wall panel 16 is placed within the groove 108 of such base member 104 and slid therealong until the edges are cooperatingly received within the grooves or recesses of column 18 and extension 90 of plate member 82.

For example, if it is assumed that the base 104 shown on the right side of FIG. 3 has been secured to column 18 and that capping or filler member 90 has also been affixed atop column 18, then the wall panel 16, also shown on the right side of FIG. 3, would be placed as to have its lower edge 58 received within groove 108 after which the panel 16, while still remaining in groove 108, would be moved therealong until edge 50 was received within aligned grooves 40 and 98 of column 18 and extension 90, respectively. Simultaneously, edges 60 and 64 of panel 16 are cooperatingly received within that portion of groove 98 which extends upwardly from extension 90. It should be observed that preferably the place of juncture between extension 90 and column 18 is at an elevation lower than the elevation of corner 51 (defined by edges 50 and 60) and corner 53 (defined by edges 52 and 62). Consequently, the strength of the panel 16 thusly received enhances the rigidity of the assembly composed of column 18 and capping member 82. When the elements are assembled as described, the upper groove 102 of member 82 and upper groove 70 of wall panel 16 are placed in functional alignment with each other.

After the above operations are completed, the next succeeding column 18 and filler or capping member 82, situated thereatop, can be moved into position against the opposite side edges of wall panel 16 and secured to the base 104 as previously described, after which the previously described operations are cyclically repeated until the wall assembly 14 is completed.

It should be apparent that in order to prevent water seepage (as might occur during a rain storm) and to prevent or at least minimize air leakage through such a wall assembly, it is preferred to have the various grooves and cooperating edges of the various components of respective dimensions resulting in tight engagement therebetween.

FIG. 4, a cross-sectional view taken generally on the plane of line 4—4 of FIG. 2, illustrates, on the left side, a column 18 and filler plate 82 in axial cross-section while on the right side, the plane of cross-section is taken along the vertical median of a wall panel 16. If the columns 18, as in one contemplated embodiment of the invention, are constructed of concrete, it becomes highly desirable to reduce the weight thereof as much as possible and consistent with structural strength and integrity. This may be done, for example, by having a hollow core 129 (preferably tapered) formed as by an axially extending paper-like tube 130 the upper end of which may be of a dimension as to closely or tightly receive the locating pin 74 therein. As typically illustrated, each of the longitudinal grooves in the column 18 is preferably provided with a radiused portion 132 blending with the continuation of such recess or groove within the respective foot portion. The primary purpose of such curvelinear portions 132 is to closely conform to the rounded corners 54 and 56 of wall panels 16 when such are assembled to the columns 18.

As generally illustrated in FIG. 4, the columns 18 and bases 104 may be situated atop a concrete slab 134. However, the practice of the invention is not limited merely to its use in combination with such a slab. That is, for example, suitable foundation type footings may be formed for the placement thereatop of such columns and bases while a floor as generally in phantom line at 136 may be poured between such columns and bases.

Figure 6:
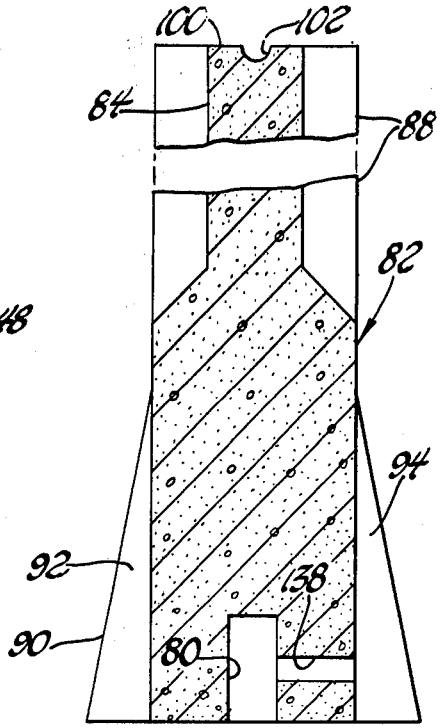
FIG. 6 is an enlarged fragmentary cross-sectional view taken generally on the plane of line 6—6 of FIG. 3 and looking in the direction of the arrows.
Figure 8:
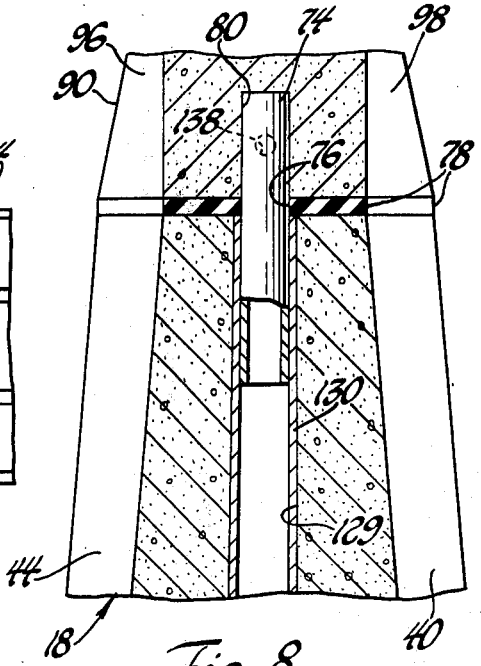
FIG. 8 is an enlarged fragmentary cross-sectional view taken generally on the plane of line 8—8 of FIG. 4 and looking in the direction of the arrows.

As best seen in FIG. 6, the recess or aperture 80 may have a second opening or passageway 138 communicating therewith. The purpose of such passageway 138 is to provide access means for the introduction therethrough of a suitable adhesive, welding or cementing agent, after the filler plate 82 is placed atop the column 18, as depicted generally by either FIGS. 2, 4 or 8, in order to bond the various coacting components and form a more unitary structure which is for all practical purposes free of any seams which might permit water or moisture passage therethrough.

Figure 7:
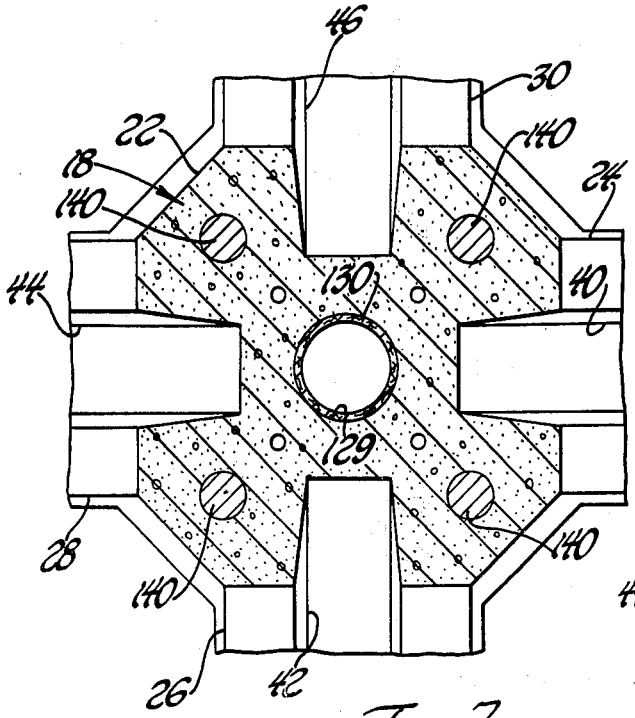
FIG. 7 is an enlarged cross-sectional view taken generally on the plane of line 7—7 of FIG. 3 and looking in the direction of the arrows.

FIG. 7, an enlarged fragmentary cross-sectional view taken generally on the plane of line 7—7 of FIG. 3, illustrates, in cross-section, the fact that addition stress reinforcing members, such as steel rods 140, may be included within the body of the column 18.

Figure 9:
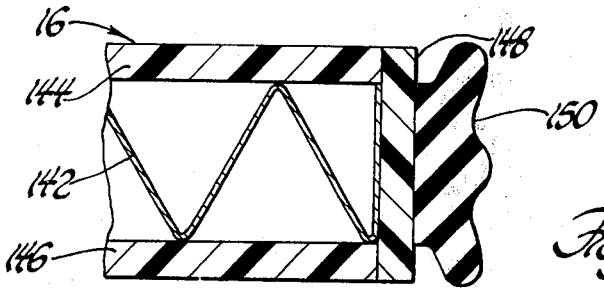
FIG. 9 is an enlarged fragmentary cross-sectional view as if taken on line 9—9 of FIG. 3 illustrating a possible configuration thereof.

FIG. 9, an enlarged fragmentary cross-sectional view taken generally on the plane of line 9—9 of FIG. 3, illustrates that in the preferred embodiment, the wall panel 16 is preferably formed of opposed sheet-like wall surfaces 146 and 144 between which is situated suitable core means 142. The periphery of the entire panel 16 may, in turn, be defined as by a suitable edging member 148 which may be secured to the wall sheets 144 and 146 by any suitable means as, for example, by cementing. Further, in the preferred embodiment, sheets 144 and 146 as well as edge 148 are formed of plastic material having a relatively low rate of thermal conductivity. Although not absolutely essential, nevertheless, it is contemplated that because of manufacturing tolerances as well as the selection of relative dimensions for ease of assembly, the various coacting elements may not, in and of themselves, achieve a tight interfit. Therefore, in order to enhance such interfits and prevent air and moisture leakage, suitable sealing means such as a functionally continuous resilient deflectable seal 150 may be affixed to the edge of panel 16 as to extend, for example, along edges 64, 60, 50, 58, 52, 62 and 66.

Figures 10, 11:
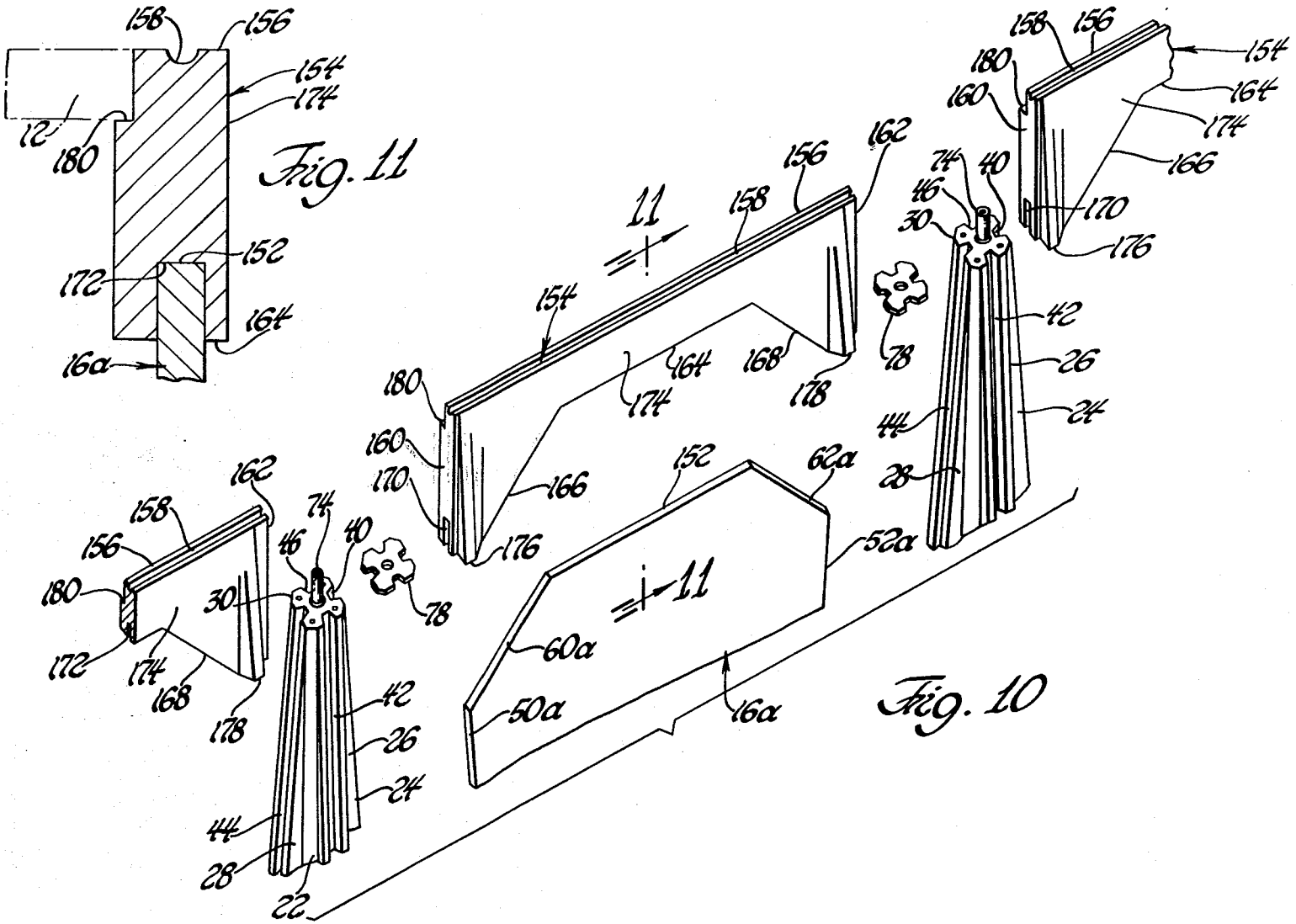
FIG. 10 is a fragmentary exploded view, somewhat similar to FIG. 3, illustrating another form of the invention.
FIG. 11 is an enlarged fragmentary cross-sectional view taken generally on the plane of line 11—11 of FIG. 10 illustrating the related elements in assembled form.

FIG. 10 illustrates a modification of the invention employing a wall panel **16*a* which, for purposes of discussion, is identical to wall panel 16 except that edges 60*a* and 62*a* (respectively corresponding to edges 60 and 62) now terminate in an upper edge 152 instead of vertical edges 64 and 66 as in FIG. 3. In order to accommodate the slightly varied configuration of wall panel 16*a*, a different form of capping or filler member 154** is employed.

As can be seen, member 154 has an upper edge 156, with a recess or groove 158 formed therein and coextensively therewith, terminating in opposed end edges or surfaces 160 and 162. A lower disposed edge 164, generally parallel to edge 156, terminates in two edges 166 and 168 extending downwardly and sloping away from each other. Similar but oppositely directed openings or recesses 170 are respectively formed in end surfaces 160 and 162 as to accommodate therein upwardly extending pins or rods 74 in each of the support columns 18 when such capping or extension members 154 are placed atop such cooperating support columns 18. The under surfaces of edges 166, 164 and 168 have a continuous groove or recess 172 formed therein as to respectively receive therein edges 60*a*, 152 and 62*a* of panel 16*a* during assembly thereof. Body 174 of extension member 154, at the outward surface thereof, is preferably provided with tapered protrusions 176 and 178 as to provide a general blending appearance with the column 18 when placed thereatop. When the extension members 154 are assembled atop columns or posts 18, respective end edges or surfaces 162 and 160 of succeeding extension members 154 are in justaposed relationship, with pin 74 received within the cavity conjointly defined by the respective recesses 170. If desired, such juxtaposed surfaces 160 and 162 may be suitably sealed or even cemented to each other, if desired.

Additionally, as also seen in enlarged cross-sectional view in FIG. 11, the extension 154 is preferably provided with a ledge or flange surface 180, extending the full length of the capping member 154, for supporting a cooperating roof structure 12, as generally depicted in phantom line.

Figure 12:
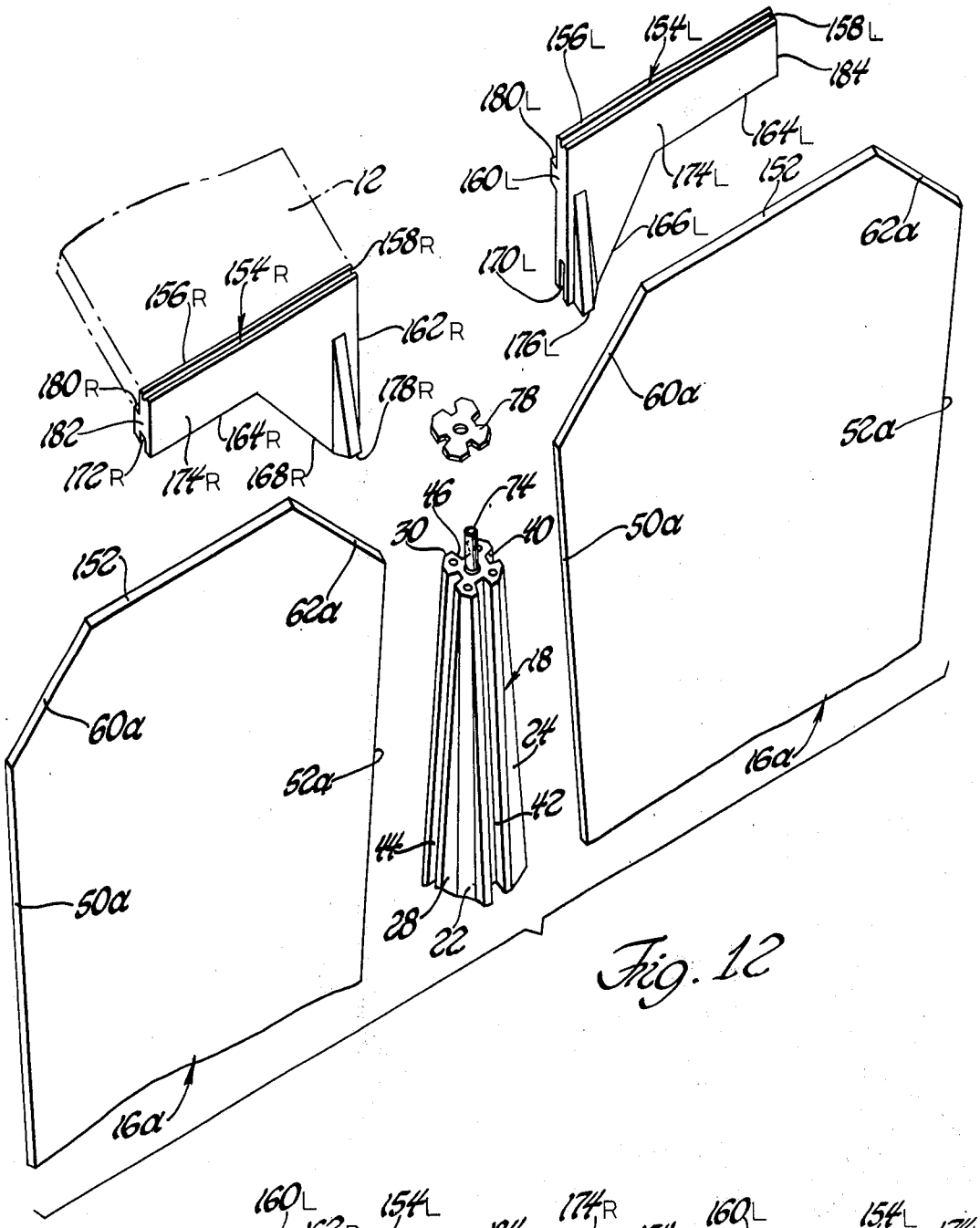
FIG. 12 is a view similar to FIG. 10 but illustrating a further embodiment of the invention.
Figure 13:
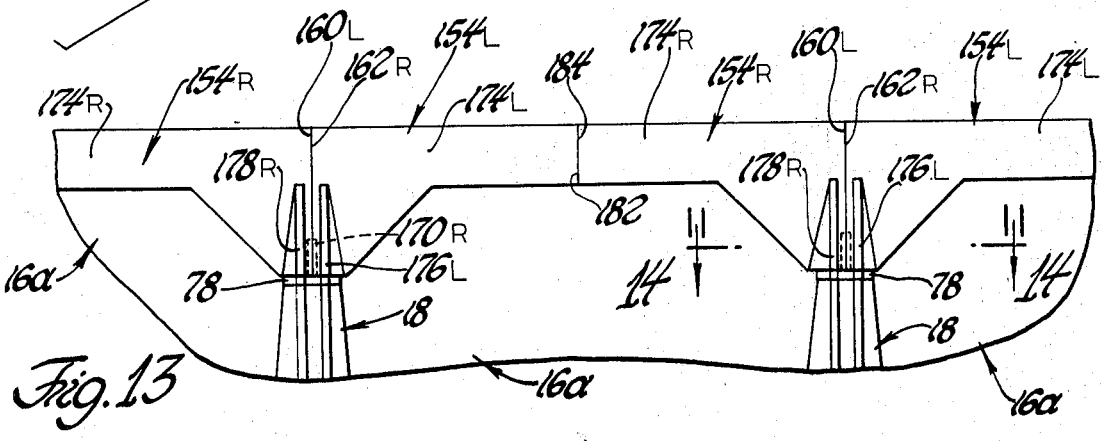
FIG. 13 is a fragmentary side elevational view illustrating the elements of FIG. 12 in assembled relationship.

FIG. 12 illustrates another modification of the invention similar to that illustrated by FIG. 10 with the main exception being that the single piece extension or capping member 154 of FIG. 10 is now made into two separate pieces which are respectively the left half and right half of original one-piece member 154. Accordingly, all elements which are like or similar to those of FIG. 10 are identified with like reference numerals while the respective capping members are identified with like reference numbers provided with a suffix R or L depending upon whether such corresponds with the right hand half of extension member 154 or the left hand half of such extension member 154. As should be apparent, sections 154R and 154L are respectively provided with end surfaces 182 and 184 which, when assembled as illustrated in FIG. 13, become juxtaposed to each other. As with relationship to surfaces 160 and 162 discussed relative to FIG. 10, surfaces 182 and 184 may be sealed or cemented, if desired.

Figure 15:
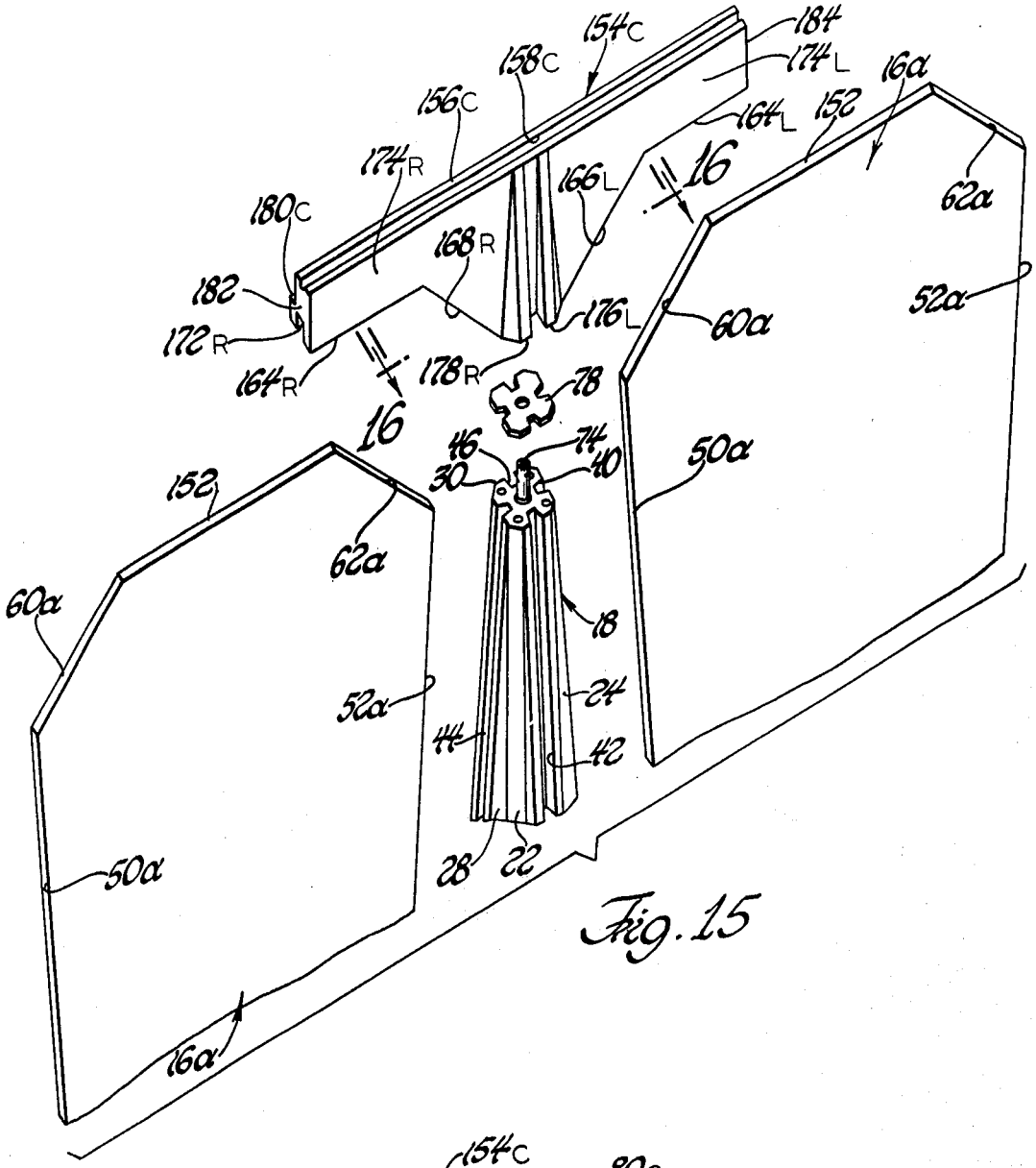
FIG. 15 is a view similar to FIG. 12 but illustrating another embodiment of the invention.
Figure 16:
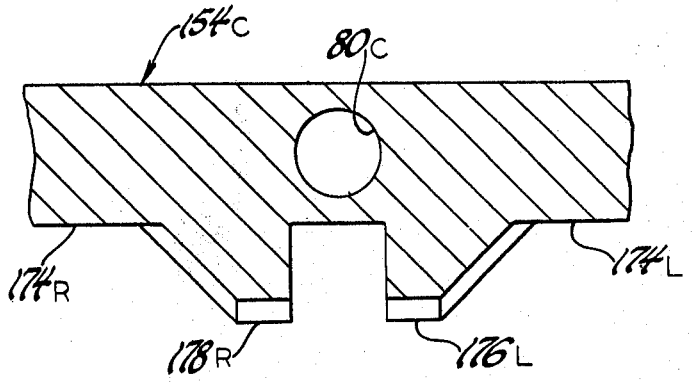
FIG. 16 is an enlarged fragmentary cross-sectional view taken generally on the plane of line 16—16 of FIG. 15 and looking in the direction of the arrows.

FIG. 15 illustrates another modification of the invention similar to that illustrated by FIG. 12 with the main exception being that the two extension pieces 154R and 154L are now made into a one piece configuration just as if the two pieces 154R and 154L shown in FIG. 12 were brought together. All elements in FIG. 15 which are like or similar to those of FIG. 12 are identified with like reference numerals with the exception that the resulting single piece capping or extension members of FIG. 15 is identified as 154C, the resulting single continuous upper edge is identified as 156C, the resulting single upper groove is identified as 158C and the single continuous flange is identified as 180C. Just as with regard to the previous embodiments described, aperture or clearance 80C is adapted for the reception therein of locating member 74.

At this point it should be made clear that the columns identified at 20 of FIGS. 1 and 2 may be identical to the columns 18 and for the purposes of FIGS. 1 and 2 they are identical. However, such corner or juncture columns may in fact assume different configurations to the extent that such configurations will accommodate a peripheral configuration of the building structure other than square or rectangular. One of such columns is illustrated by FIGS. 17 and 18.

Figure 17:
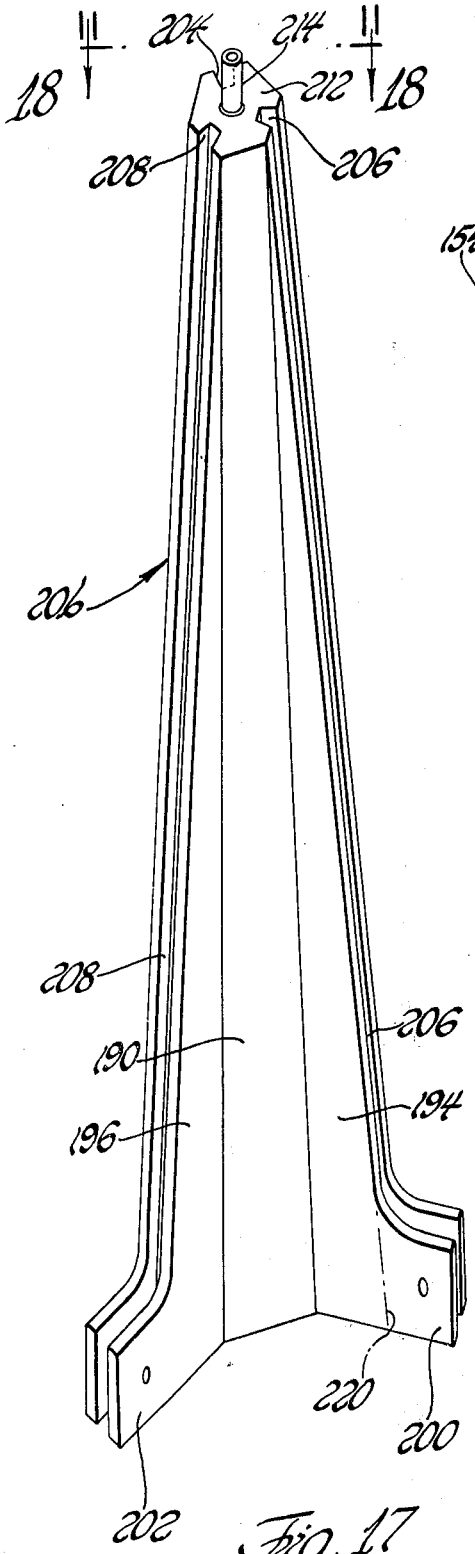
FIG. 17 is an elevational perspective view of another form of one of the elements embodying the teachings of the invention.
Figure 14:
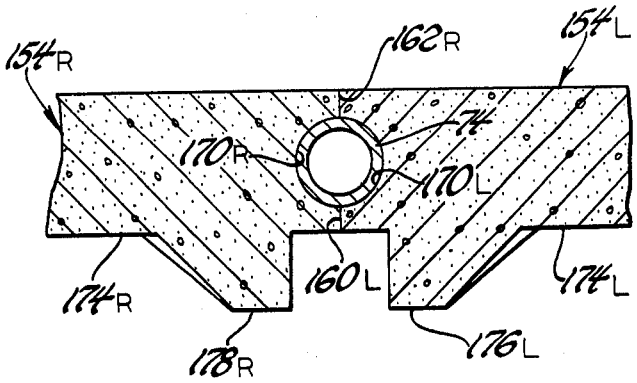
FIG. 14 is an enlarged fragmentary cross-sectional view taken generally on the plane of line 14—14 of FIG. 13 and looking in the direction of the arrows.
Figure 18:
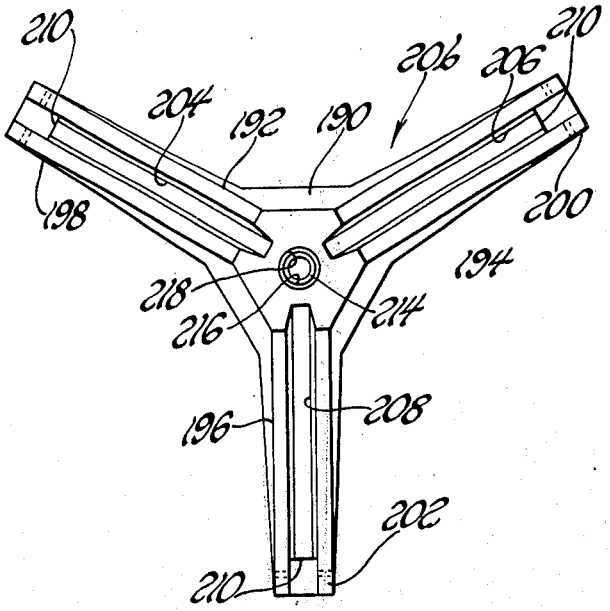
FIG. 18 is an enlarged top plan view of the column of FIG. 17 taken generally on the plane of line 18—18 and looking in the direction of the arrows.

Column 20*b* of FIGS. 17 and 18 is illustrated as being comprised of a main vertically extending body portion 190 having axially extending legs 192, 194 and 196 preferably formed integrally therewith and angularly spaced thereabout as, for example, at 120° intervals. Legs 192, 194 and 196 respectively terminate in aligned foot-like portions 198, 200 and 202. Further, grooves or recesses 204, 206 and 208 are respectively formed in legs 192, 194 and 196 in a manner as to extend downwardly into the respective aligned foot portions 198, 200 and 202. Similarly too, as best shown in FIG. 4, each of the foot portions 198, 200 and 202 has a vertically extending slot 210 formed therein into which the grooves 204, 206 and 208 respectively terminate.

The top of column 20*b* is preferably truncated, as at 212, and provided with an upwardly extending locating member 214 received as within an axially extending tube 216 and which functions in the same manner as locating member 74. As with reference to core 129 of FIG. 4, a column 20*b* is also similarly provided with an axially extending core 218.

As should be evident from FIGS. 17 and 18, it is possible to form columns functionally equivalent to columns 18 of FIGS. 1 and 2 but having less or greater number of legs as well as having such legs spaced from each other by different angular degrees.

Figure 5:
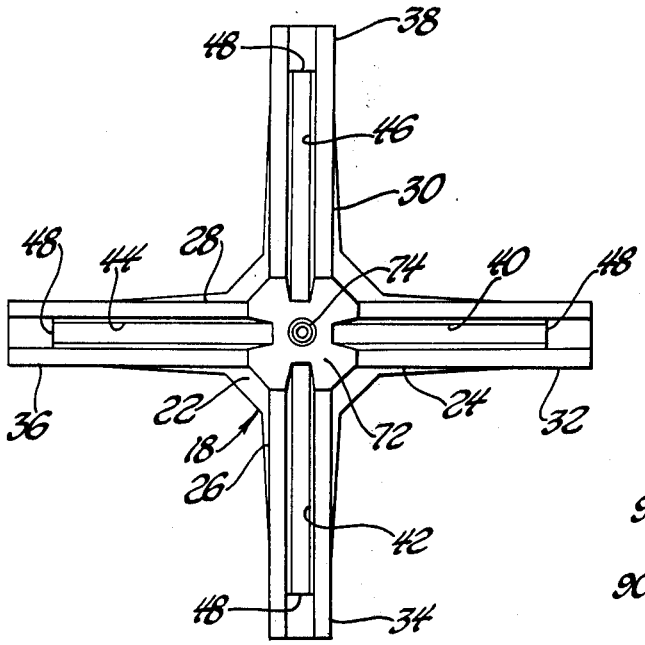
FIG. 5 is an enlarged top plan view of the column of FIG. 4 taken generally on the plane of line 5—5 of FIG. 4 and looking in the direction of the arrows.

The various columns contemplated by the invention may assume other varied or modified forms depending, especially, on their particular intended use. For example, it is conceivable that because of certain considerations only three of the four legs and foot portions illustrated in, for example, FIG. 5 would be desired. In such event the column could be fabricated to exclude possibly leg 30 and foot portion 38 while retaining the remaining legs and foot portions as shown. In other instances, especially in the interior of buildings, it may be desirable to eliminate the interior foot portion. This could be achieved, for example, by forming the related leg portion to have a continuous downwardly extending contour as illustratively depicted by phantom line 220 in FIG. 17. Further, even though the various columns 18, 20 and 20*b* have been described as being formed of concrete, it is specifically contemplated that such can be and will also be formed of plastic material as by, for example, molding. By so doing the overall weight of such columns can be kept at an absolute minimum while at the same time providing all of the necessary structural strength.

In forming such columns of either concrete, plastic or some other suitable material, it should be made clear that the exterior surfaces thereof can be enhanced and tailored to the exact aesthetic requirements of the overall structure as well as to the surrounding environment. That is, it is possible to create a surface-like layer of any texture, configuration or design as well as the selection of the color thereof.

Although it has been stated that in the preferred embodiment of the invention the wall panels 16, 16*a* are preferably formed of a laminated construction employing plastic material as panel sheets, such wall panels may, nevertheless, be formed of any sutiable material and may be of solid cross-sectional configuration.

Figure 19:
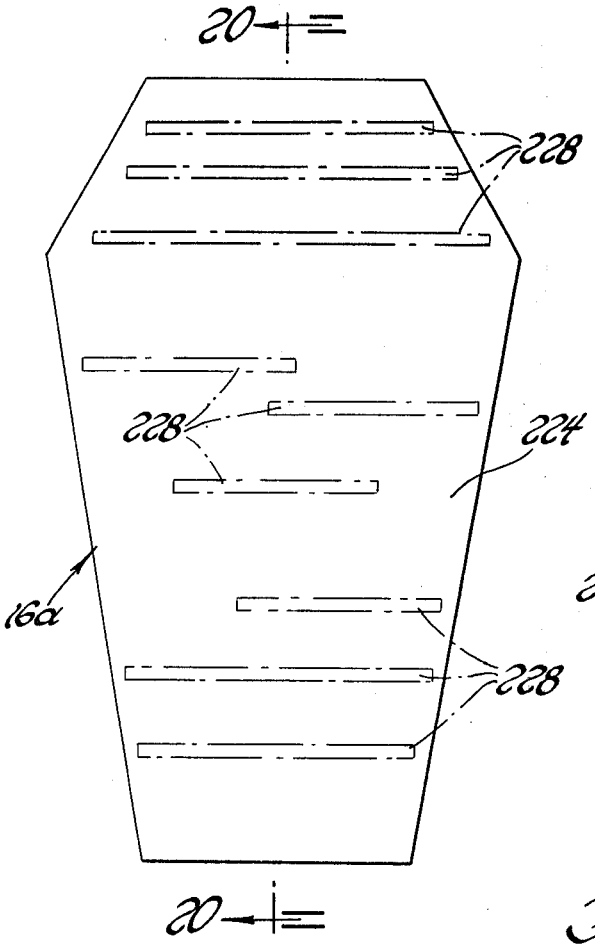
FIGS. 19, 22, 23, 24 and 25 are side elevational views of some typical wall panel constructions.
Figure 20:
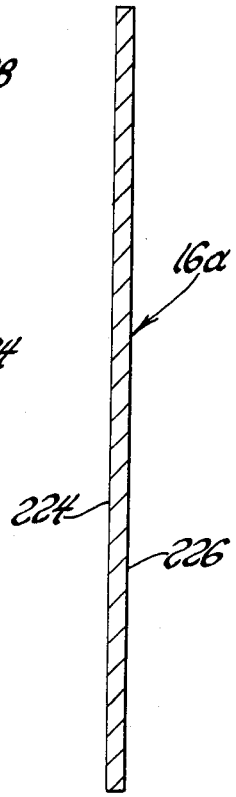
FIGS. 20 and 21 are each cross-sectional views taken generally on the plane of line 20—20 of FIG. 19.
Figure 21:
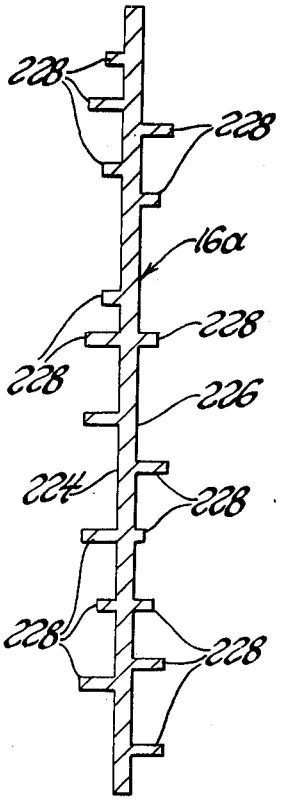

For example, FIG. 19 illustrates a typical wall panel 16*a* in elevation with such panel being of any suitable material and either of hollow core or solid in cross-section. (For ease of illustration in FIGS. 20 and 21 such are shown as if the panel 16*a* was solid in cross-section.) FIG. 20, a cross-sectional view taken generally on the plane of line 20—20 merely illustrates that the opposed exposed surfaces 222 and 224 may in fact be planar and free of any interruptions therein, while FIG. 21, also a view taken generally on the plane of line 20—20, illustrates that the surfaces 224 and 226 may be provided with projecting portions 228 (shown in phantom line on FIG. 19) selected and located in positions for desired aesthetic effect.

Figure 22:
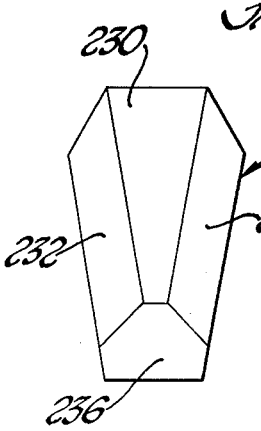
Figure 23:
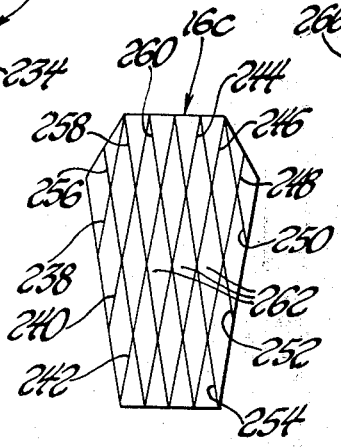
Figure 24:
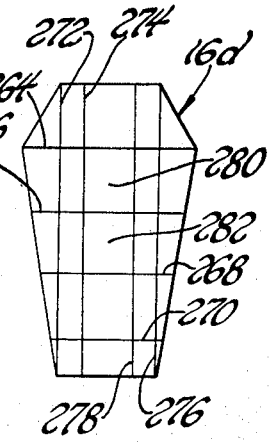

FIGS. 22, 23 and 24 typically illustrate, in 256, 258 other possible constructions of wall panels 16*b*, 16*c* and 16*d*. For example, wall panel 16*b* could be formed from separate sheet portions 230, 232, 234 and 236 or, in the alternative, could be so contoured as to have the appearance of such separate sheet portions but, in reality be a single integrally formed panel sheet. As generally depicted in FIG. 23, the panel sheet may also be formed with inclined strength reinforcing means as generally indicated by intersecting lines 238, 240, 242, 244, 246, 248, 250, 252, 254, 258 and 260 and that, if desired windows may be provided as at 262. The same generally applies to wall panel 16*d* of FIG. 24 wherein the intersecting strength reinforcing means are depicted by horizontal lines 264, 266, 268 and 270 and vertical lines 272, 274, 276 and 278, while portions 280 and 282 may represent window means.

Figure 25:
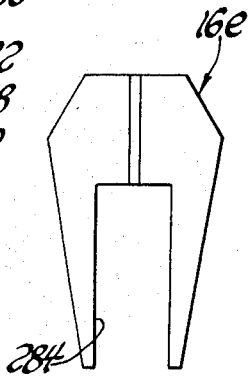

FIG. 25 is intended only to illustrate the fact that such wall panels 16*e* may, in fact be formed with a suitable opening as at 284 in order to define a passageway therethrough. Such opening 284 may, of course, be fitted with a door frame assembly and door if such be desired.

Although it is believed obvious, nevertheless it might be best to specifically point out that, as shown in FIGS. 1 and 2, the corner columns 20 support a capping or filler member 79 functionally equivalent to members 82 except that the body of member 79 is formed as to have body portions 81 and 83 which are at an angle to each other as to thereby conform to the angle formed by the wall assemblies at that particular corner.

Figure 26:
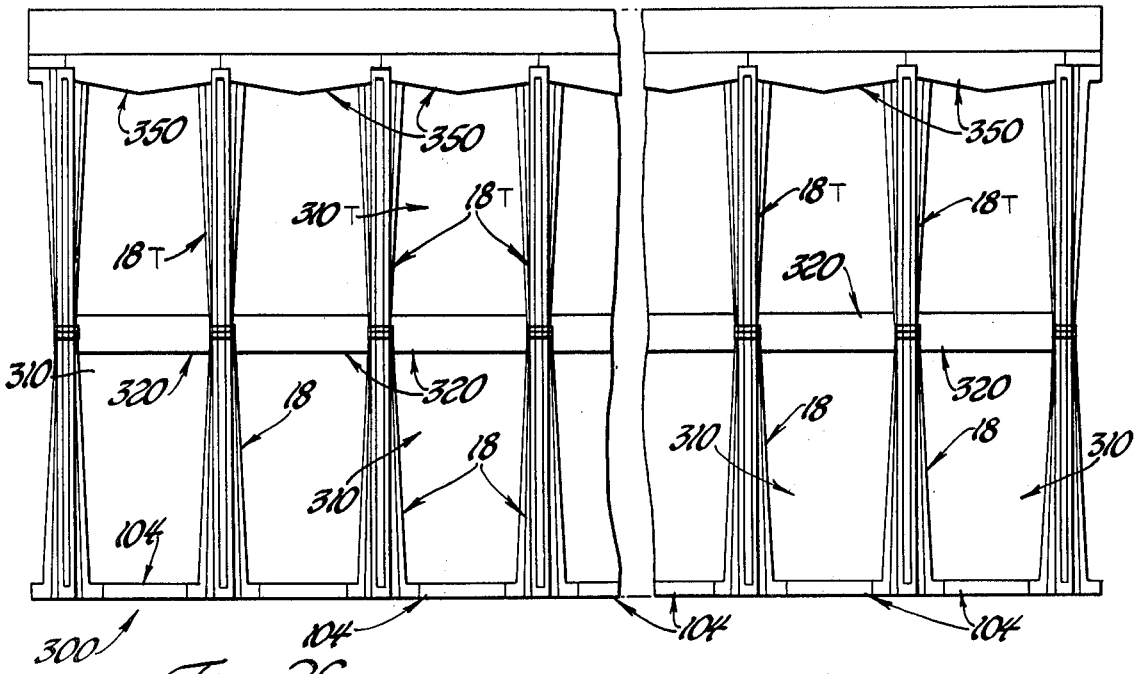
FIGS. 26 and 27 correspond to FIGS. 1 and 2 but illustrate a multi-floor type of structure embodying the teachings of the invention.
Figure 27:
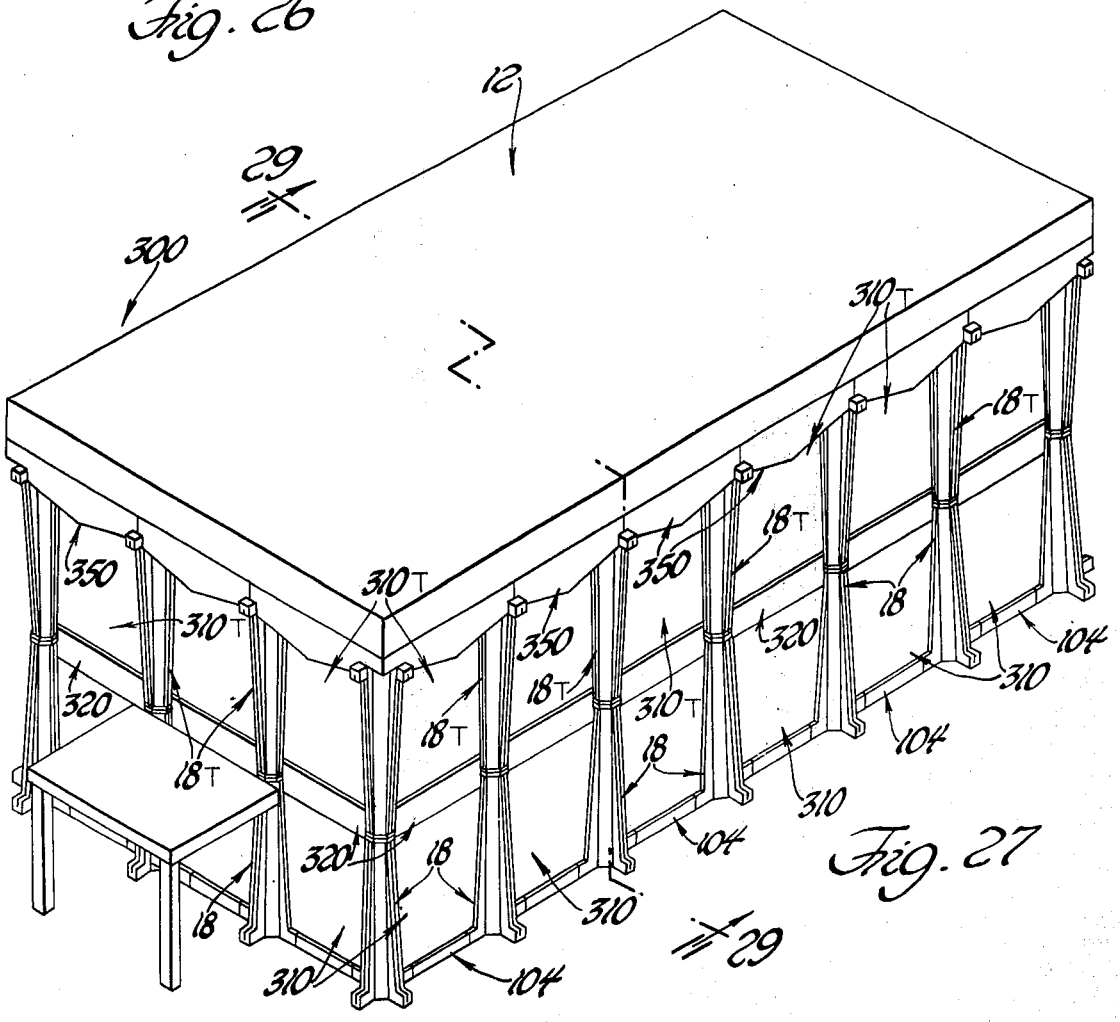

FIGS. 26 and 27 are similar respectively to FIGS. 1 and 2 in that they also illustrate a building structure constructed in accordance with the teachings of the invention with the exception that the building 300 is of a multi-story construction. All elements which are like or similar to those of the preceding Figures are identified with like reference numerals. The various members which are identified with a reference number provided with a suffix, T, correspond to those members having the same reference number appearing at the lower part of FIG. 28. The only purpose for designating the "T" is for ease of reference since such "T" designation is intended to connote that member's relative position, namely, top.

Figure 28:
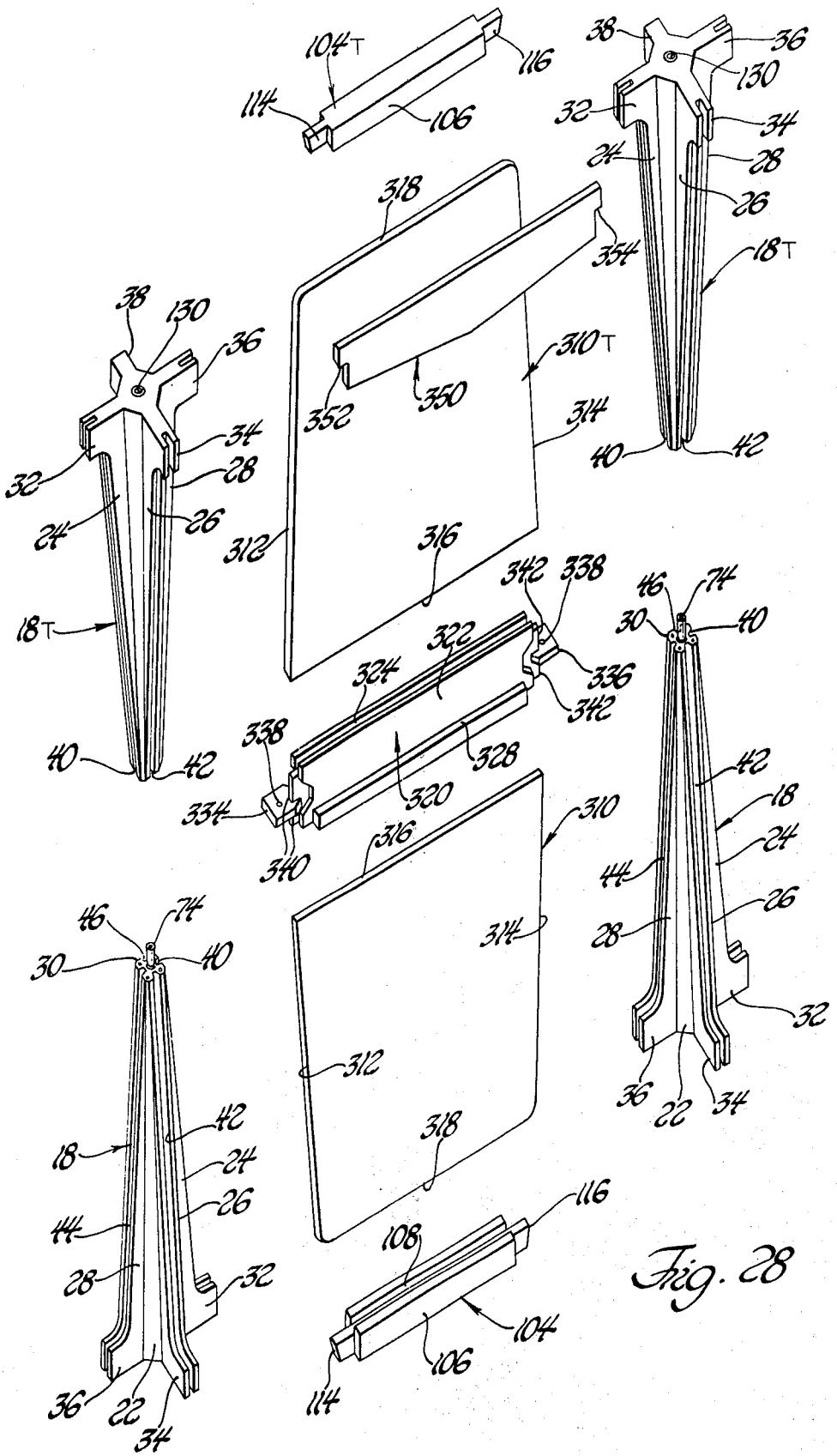
FIG. 28 is a view similar to FIG. 3 but illustrating various elements of the structure of FIGS. 26 and 27 in exploded perspective.

Referring in greater detail to FIG. 28, it can be seen that wall panels 310 and 310T are again preferably of trapezoidal configuration having inclined side edges 312 and 314 which terminate at one end in an edge 318 and at the other end in an edge 316. Edge 318 of panel 310 is adapted to be received within groove 108 of base 104 while edge 318 of panel 310T is similarly adapted to be received within groove 108 of member 104T. Side edges 312 and 314 of panel 310 are adapted to be received as within grooves 40 and 44, respectively, of succeeding columns 18 while edges 312 and 314 of panel 310T are respectively received within grooves 44 and 40 of succeeding columns 18T respectively juxtaposed to the columns 18.

Figure 29:
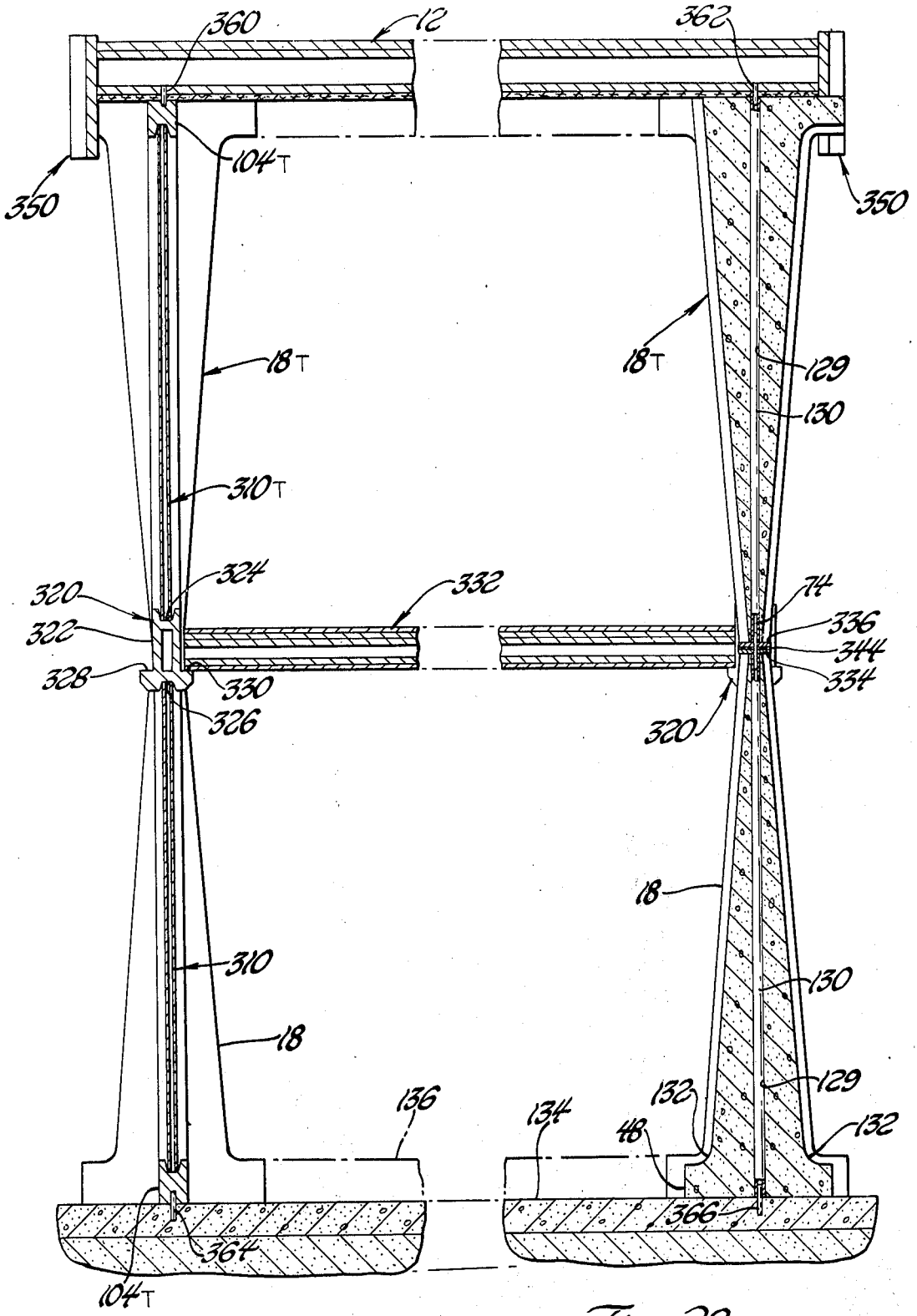
FIG. 29 is an enlarged fragmentary cross-sectional view taken generally on the plane of line 29—29 of FIG. 27 and looking in the direction of the arrows.

A connecting piece or member 320 is shown as comprising a longitudinally extending body 322 with an upwardly directed groove 324 formed therein and extending generally coextensively with the body 322. A second lower disposed downwardly directed groove 326 is also formed in body 322 and extends generally coextensively therewith. Body 322 is also provided with preferably integrally formed longitudinally extending flange portions 328 and 330 which, as best seen in FIG. 29, provide means for the support of the upper floor assembly 332. Laterally extending anchoring portions or tabs 334 and 336 are provided with apertures 338 for the respective reception therethrough of locating or assembly pins 74. Additionally, preferably, vertically extending projecting portions 340 and 342 are provided which are preferably at least partially received within the axially extending grooves of the columns 18 and 18T.

In assembled relationship, the base member 104 would be connected to spaced succeeding columns 18 and wall panel 310 would be received within groove 108 of base 104 as well as the longitudinal grooves of the spaced cooperating columns 18 as previously described. Next, the connecting member 320 is placed over edge 316 of panel 310 and pins 74 of columns 18. At this point it should be noted that in the preferred form of the invention, tab 336 is at an elevation slightly higher than opposite tab 334 thereby allowing for the placement, about a single pin 74, of tab 334 of one connecting member 320 and thereatop the tab 336 of the next succeeding connecting member. Of course, as previously described, suitable seals such as that disclosed at 78 and as generally indicated at 344 of FIG. 29 may be employed.

Subsequently, panel 310T is placed as to have its edge 316 received in upper slot 324 of connecting member 320 and columns 18T are placed respectively atop the tab portions of connecting members 320 in a manner preferably whereby pins 74 are received within the hollow portions of columns 18T as generally depicted in FIG. 29. Edges 312 and 314 are also received within cooperating grooves of columns 18T. Finally, upper disposed member 104T is connected via extensions 114 and 116 to foot portions 36 and 32 of columns 18T and, in so doing, receives edge 318 of wall panel 310T within its groove 108.

The invention also provides means for the ready attachment of facia members 350. That is, as illustrated in both FIGS. 28 and 29, facia means 350 is provided with opposed cut-out portions 352 and 354 as to enable the mounting thereof as by placing cut-out portion 352 over foot 34 and cut-out portion 354 over foot 34 of the next succeeding column 18T. The width of such cut-out portions is such as to extend approximately half the width of cooperating supporting foot portions. The facia means may, of course, be secured in any suitable manner as, for example, by either mechanical fastening means or suitable cementing means.

In addition to other anchoring means discussed, further anchoring means such as depicted at 360, 362, 364 and 366 may be employed to further assure adequate securing of cooperating components.

Any suitable roof assembly or structure may be employed. However, it should be evident that the invention provides a basic structure wherein such a roof assembly 12, if desired, may be layed across the supporting wall assemblies. In some situations where the roof is actually placed atop the wall assemblies, grooves, as disclosed for example at 70, 102 and 158 are employed to receive suitable sealing means, as depicted at 368 of FIG. 4, for forming a sealing barrier as between the roof assembly and the supporting walls.

Figure 30:
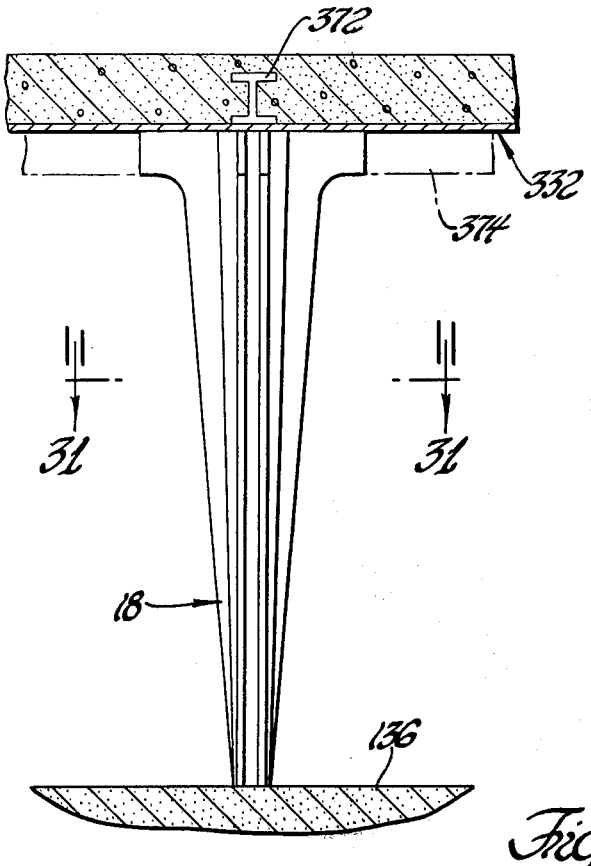
FIG. 30 is a fragmentary view, partly in cross-section and partly in elevation illustrating the inverted employment of one of the elements of the invention.
Figure 31:
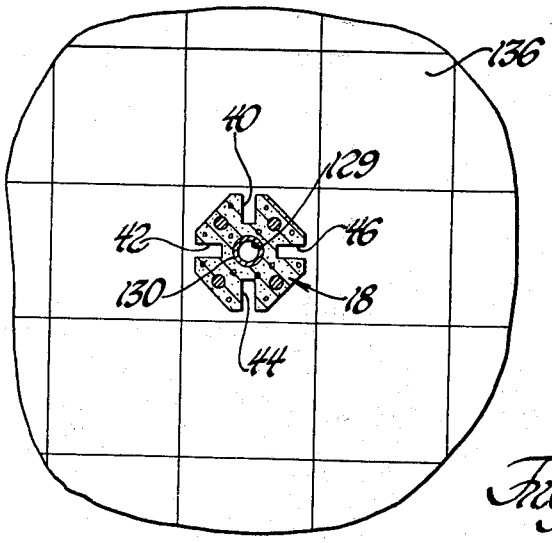
FIG. 31 is a cross-sectional view taken generally on the plane of line 31—31 of FIG. 30 and looking in the direction of the arrows.

FIG. 30 illustrates the use of what might be considered an inverted column 18 which, for purposes of discussion is depicted as being an interior support column. That is the foot portions are located upper-most as to provide comparatively large support surfaces for supporting beams 372 and other structural members passing thereover. Further, the reduced size of the lower end of the inverted column 18 also provides for greater useful floor space. It should be brought out that the grooves 40, 42, 44 and 46 (all or any of them) may be employed as passage means for enabling, for example, the drawing therethrough of telephone or electrical cable, as from above a drop-type ceiling 374, to any selected location in proximity to such related inverted column 18. Further after such cables are drawn through the grooves, suitable facing-like cover means (not shown) may be placed in the grooves as to cover such cables.

Although the preferred form of the invention employs trapezoidal wall panels, it should be clear that wall panels of other configurations may be employed without departing from the spirit of the invention. However, it has been discovered that panels having inclined side edges, such as at 16, provide the best means for dissipating loading stresses, imposed on such panels from atop thereof, to the spaced cooperating columns or posts.

Figure 32:
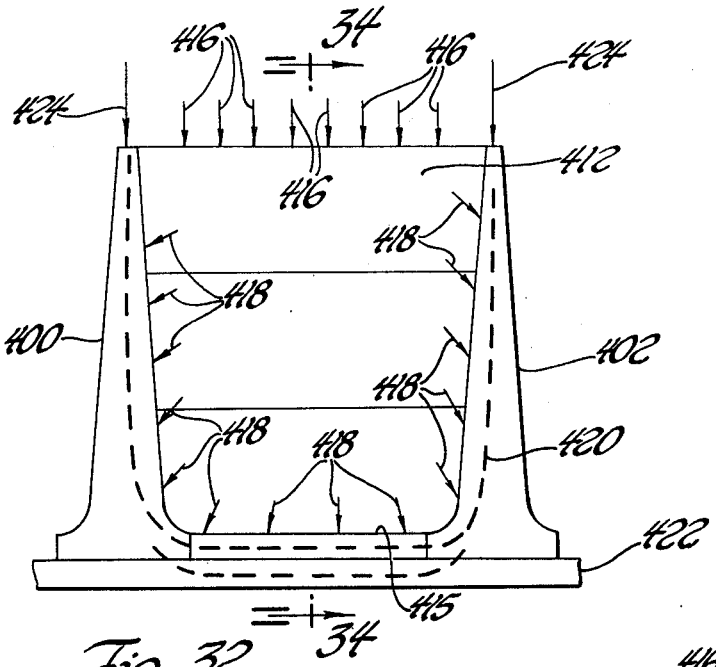
FIG. 32 is simplified illustration of a pair of columns and cooperating wall panel member illustrating typical tension stress patterns therein.

FIG. 32 is a somewhat simplified illustration of two columns 400, 402 and cooperating wall panel member 412. (This is a typical type of illustration and such reference numbers as are employed are used merely for ease of specific reference.) Assuming that the columns 400 and 402 are operatively connected to each other as by a base member 415 and a wall panel member 412 is situated therein, let it further be assumed that there is a generally equal loading at the top of the wall member 412 as depicted by the arrows 416. With such an assumption, it can be seen that, because of the inclined coacting side edges, resultant forces as indicated generally by arrows 418 will act against columns 400 and 402 as well as the base member 415. As a consequence of such resultant forces, the entire system is placed in tension as generally indicated by the heavy dash line 420 which passes through columns 400, 402 and base 415. If the columns 400 and 402 are not anchored to each other through the agency of a base member 415 but instead operatively connected to each other as by being individually anchored as through a related floor or foundation 422, the tension stress line (shown in heavy dash line-work) would pass through such support 422 also placing it in tension. Obviously, depending on how the columns 400 and 402 are operatively connected to each other, such tension stress lines could pass through both a base member such as at 415 and the support 422.

By placing such materials in tension, maximum utilization of the strengths of such materials is achieved. That is, the columns 400 and 402 need not have cross-sectional thicknesses as is necessary by the prior art to carry the full loads in compression. Further, in view of the fact that succeeding wall panel members actually have vectors of the resultant forces 418 generally horizontally disposed and oppositely directed against the column between such panels, such column thereby has its inherent rigidity increased further enabling the carrying of any load placed directly thereatop as depicted by either of arrows 424.

Figure 33:
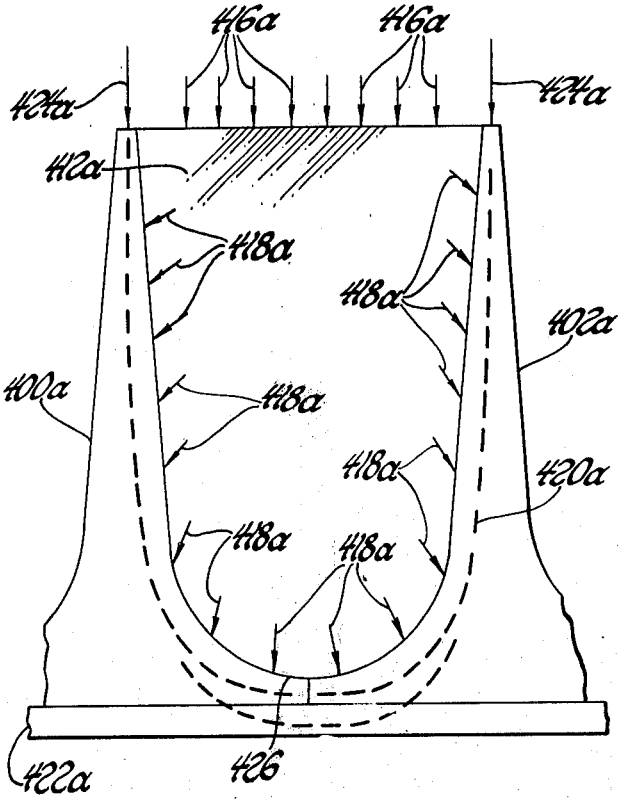
FIG. 33 is a view similar to FIG. 32 but illustrating a slight modification thereof.

FIG. 33 is a view similar to FIG. 32 but illustrating the fact that the panel member may actually have other configurations including, for example, an arcuate or circular edge configuration 426. All elements which are like or similar to those typically illustrated in FIG. 32 are identified with like reference numbers provided with a suffix "a".

In view of the above, it can be seen that columns such as 400 and 402 (or other corresponding columns as hereinbefore disclosed) are not necessarily columns in the usual sense of the word in that they do not (and in the preferred embodiment will not be) necessarily carry the full roof or upper floor loads in compression as do the "columns" referred to by the prior art. That is, regardless of the actual use, that is, interior or exterior wall systems, the invention provides modular stress or load bearing means which has the appearance of spaced conventional columns and intermediate non-load bearing wall panels.

Figure 34:
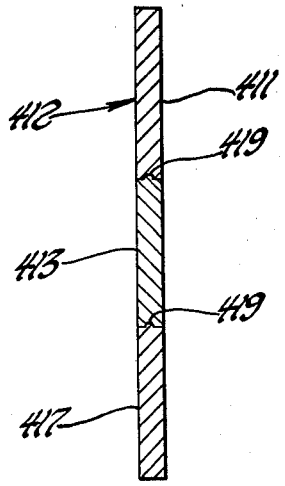
FIG. 34 is a cross-sectional view of one of the elements shown in FIG. 32, taken generally on the plane of line 34—34 and looking in the direction of the arrows.

Further, as generally typically depicted by FIG. 34, a wall panel member or means 412 may actually be comprised of a series of abutting wall portions 411, 413 and 417 which, if desired, may also include suitable interlocking means 419. It should also be mentioned that the term, building structure, is herein employed not only to designate an entire building but any sub-component thereof as well as any wall-type section or portion thereof.

Although only a select number of preferred embodiments of the invention have been disclosed and described, it is apparent that other embodiments and modifications of the invention are possible within the scope of the appended claims.

I claim:

1. A base member for laterally interconnecting succeeding structural column members, said base member comprising body means, said body means comprising a lower disposed mounting surface, an upper situated surface, first and second oppositely disposed side surfaces, first and second oppositely disposed end portions, slot means formed in said body means and through said upper situated surface, aperture means located generally between said first and second end portions and formed through said body means as to be directed generally transversely to said upper surface, said aperture means being effective to receive therethrough related anchoring means whereby said body means is secured to associated support structure supporting said body means along said lower disposed mounting surface, and first and second connecting portions generally respectively extending beyond said first and second end portions, said first and second connecting portions each having an uppermost surface at an elevation substantially below the elevation of said upper situated surface and being effective for operative connection to respective first and second of said succeeding structural column members as to thereby be situated generally between said succeeding column members.

2. A base member according to claim 1 wherein said first and second connecting portions each comprise an extension integrally formed with said body means and extending generally longitudinally thereof.

3. A base member according to claim 1 wherein said first and second connecting portions each comprise an extension integrally formed with said body means and extending generally longitudinally thereof, and wherein said aperture means comprises a generally elongated aperture elongated in a direction generally parallel to said slot means.

4. A base member according to claim 2 wherein said aperture means comprises at least two generally elongated apertures each elongated in a direction generally parallel to said slot means.

5. A base member according to claim 2 wherein said slot means comprises an elevationally lower slot end surface extending longitudinally of said body means, and wherein said slot end surface terminates at an elevation which also is the same elevation as that of said uppermost surfaces of said first and second extensions.

6. A base member according to claim 5 wherein each of said first and second extensions have oppositely formed first and second extension side walls, and wherein respective pairs of said first and second extension side walls are situated closer to each other than are said first and second side surfaces as to thereby generally be between said first and second side surfaces.

7. A base member according to claim 6 and further comprising connecting means carried by each of said first and second extensions, said connecting means being effective for affecting a positive mechanical connection with a cooperating structural column member.

* * * * *

UNITED STATES PATENT OFFICE

CERTIFICATE OF CORRECTION

Patent No. 3,968,617 Dated July 13, 1976

Inventor(s) JOHN S. HODGE

It is certified that error appears in the above-identified patent and that said Letters Patent are hereby corrected as shown below:

Column 3, line 42, after "integrally" change "therwith" to --- therewith ---.

Column 9, line 8, after "in" cancel "256, 258" and substitute therefor --- elevation, ---.

Column 9, line 18, immediately after "254," insert --- 256, ---.

Signed and Sealed this

*First* Day of *May 1979*

[SEAL]

*Attest:*

RUTH C. MASON
*Attesting Officer*

DONALD W. BANNER
*Commissioner of Patents and Trademarks*